United States Patent [19]

Dolza

[11] 4,359,979

[45] Nov. 23, 1982

[54] SPLIT ENGINE CONTROL SYSTEM

[76] Inventor: John Dolza, 810 State St., Fenton, Mich. 48430

[21] Appl. No.: 73,886

[22] Filed: Sep. 10, 1979

[51] Int. Cl.[3] ..... F02D 17/02; F02M 25/06

[52] U.S. Cl. ..... 123/198 F; 261/23 A; 60/288; 123/568

[58] Field of Search ..... 123/198 F, 568, 570; 261/23 A; 60/288

[56] References Cited

U.S. PATENT DOCUMENTS

| | | | |
|---|---|---|---|
| 2,114,655 | 4/1938 | Leibing | 123/198 F |
| 2,623,617 | 12/1952 | Snyder et al. | 123/198 F |
| 2,652,038 | 9/1953 | Winglen | 123/198 F |
| 4,076,003 | 2/1978 | Garabedian | 123/198 F |
| 4,114,374 | 9/1978 | Tanahashi | 123/198 F |
| 4,130,102 | 12/1978 | Churchill | 123/198 F |
| 4,192,278 | 3/1980 | Lizuka et al. | 123/198 F |
| 4,198,940 | 4/1980 | Tshida | 123/198 F |
| 4,201,180 | 5/1980 | Lizuka | 123/198 F |

*Primary Examiner*—Ira S. Lazarus

[57] ABSTRACT

A cylinder cut-out system including an intake manifold having first passage means communicating with one half of the engine combustion chambers; second passage means communicating with the other half of the engine combustion chambers; an air metering mechanism having passage means for respectively supplying a combustible air-fuel mixture or metered air to the first and second manifold passage means; and a control device having first and second valves that prevent mixture flow to the manifold passage to be inactivated, and open the manifold passage to either atmosphere or the exhaust manifold, respectively.

7 Claims, 25 Drawing Figures

SECTION D D

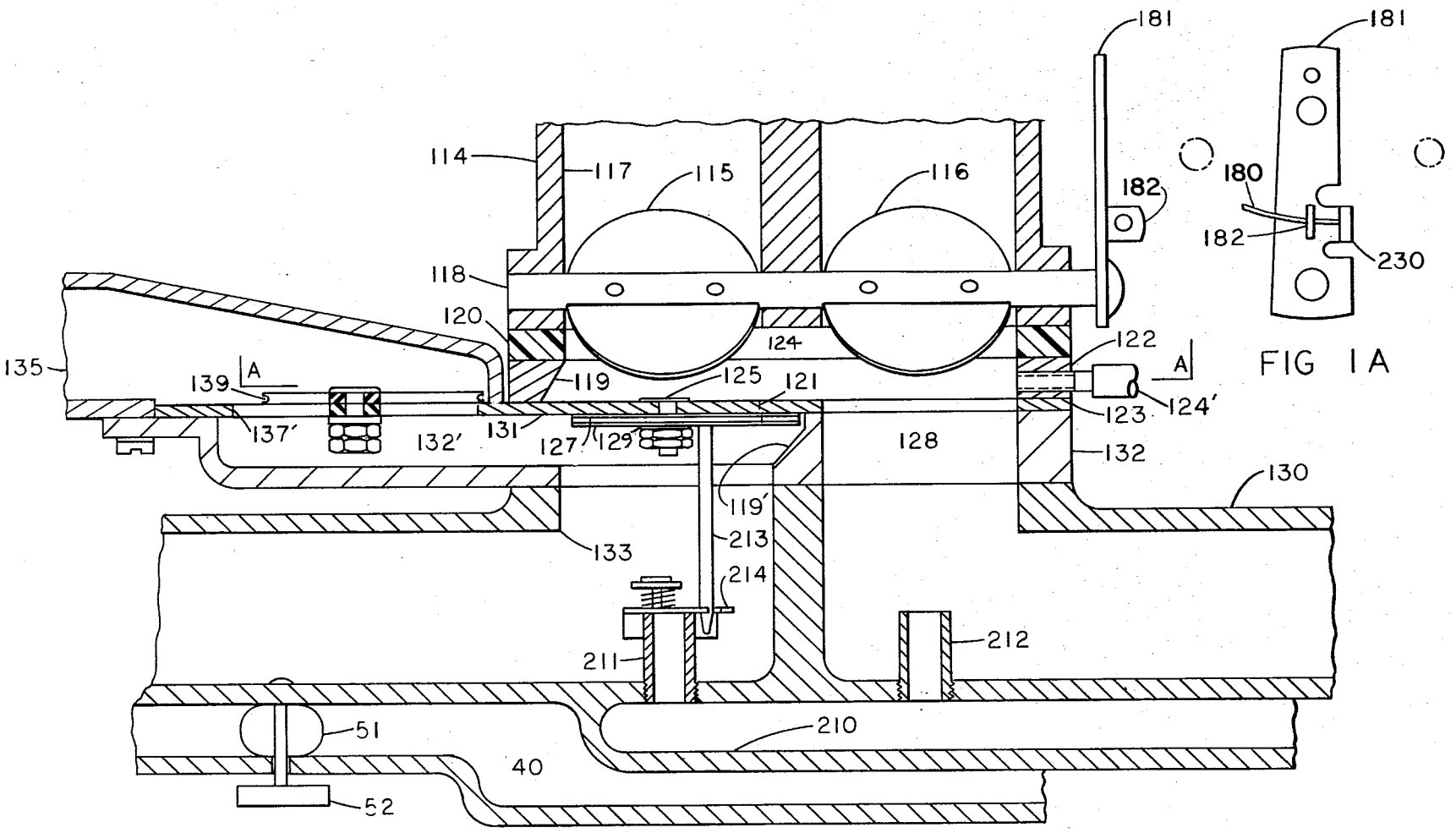
FIG 1 SECTION D D

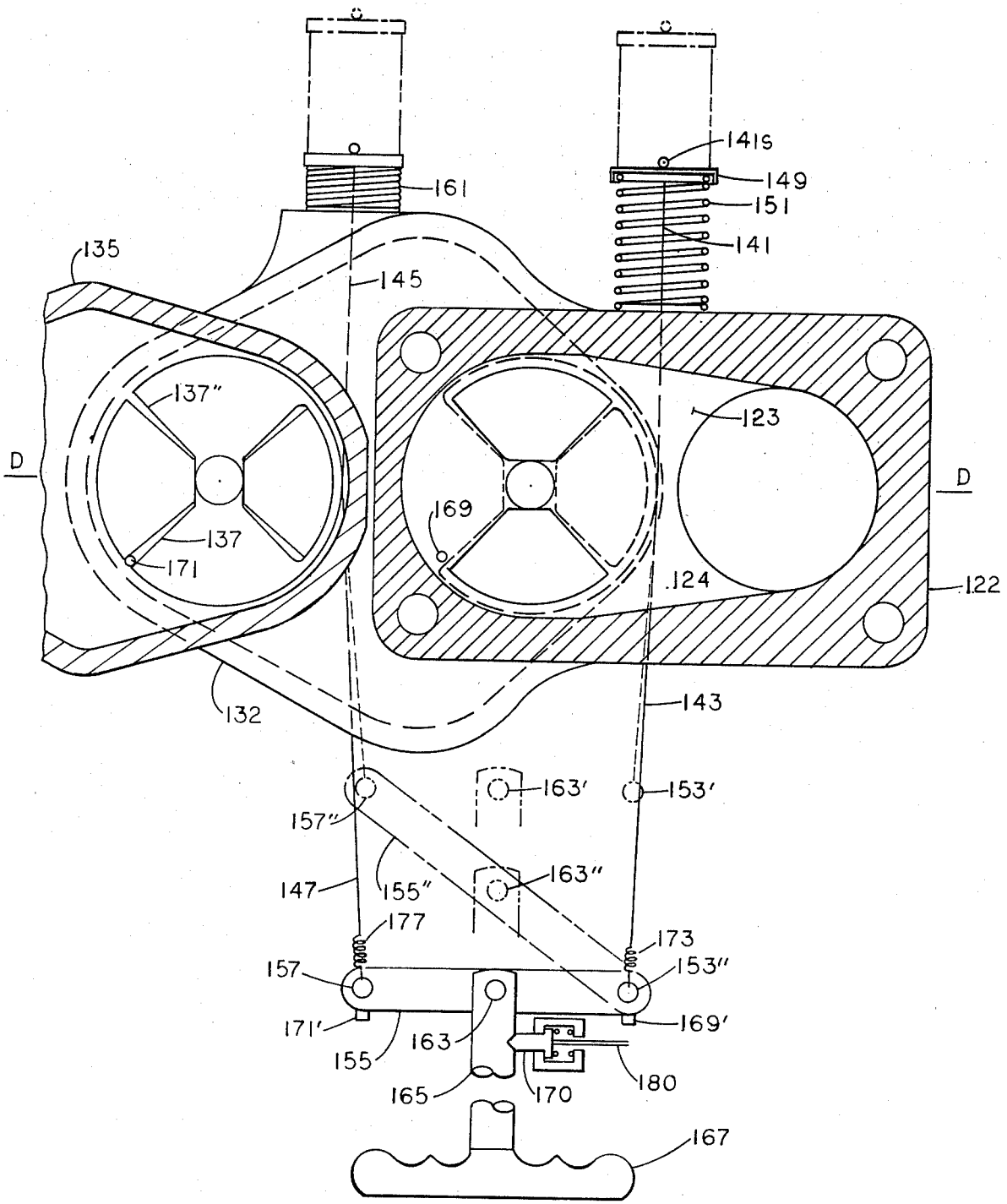
FIG 2 SECTION A A

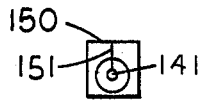
FIG 3D
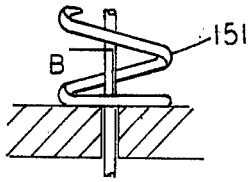
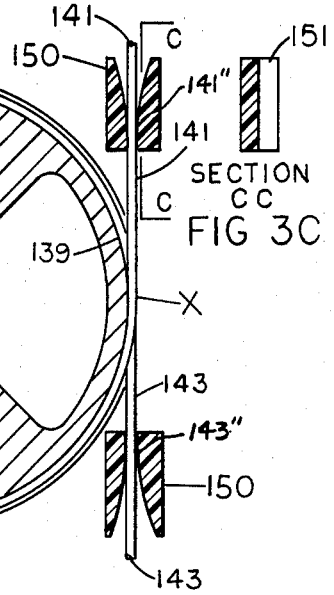
FIG 3C
FIG 3B SECTION B B
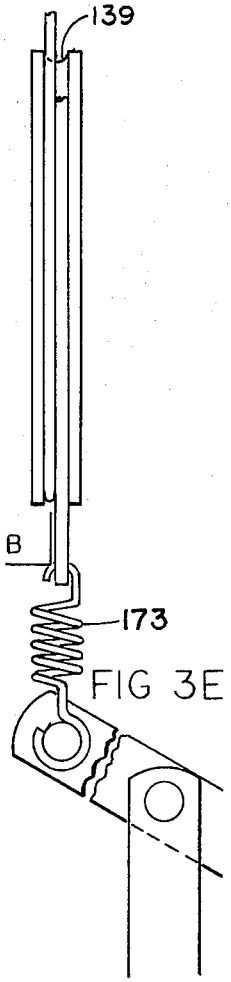
FIG 3E
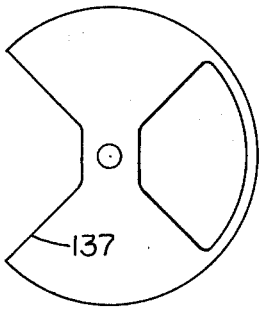
FIG 3
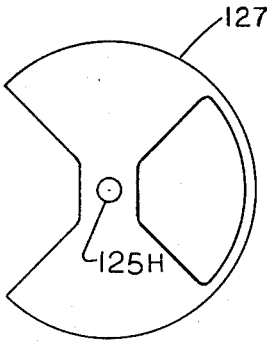
FIG 3A
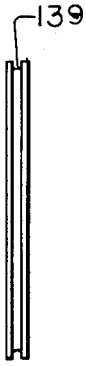
FIG 3AA
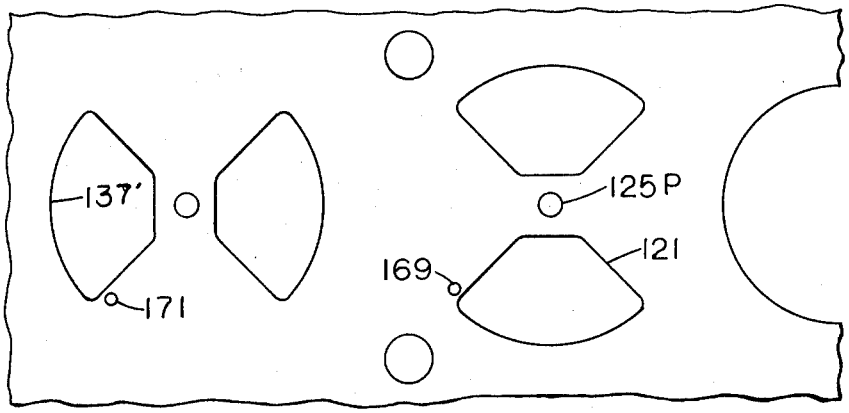
FIG 4

SECTION F F

SECTION E E

SPLIT ENGINE CONTROL SYSTEM

BACKGROUND OF THE INVENTION

The present invention relates to a control system for an internal combustion spark ignition engine which permits the engine to be run on less than all of its cylinders in order to achieve substantial economies in engine operation. Such a capability is sometimes referred to as "split-engine" operation through which it is possible to operate on one-half of the cylinders.

Engine operation is more econommical if each cylinder of the engine is run under relatively high loads. However, under a large percentage of vehicle operating conditions the engine is operating under relatively light loads resulting in uneconomical fuel consumption. Accordingly, it is desirable to operate the engine on half of the cylinders during normal or light load operation with the remaining cylinders being brought into operation only after the load on the engine exceeds a given value. In this way it is possible to increase the load on each of the active cylinders and in that way achieve greater overall economies for the engine.

More specifically, to operate an engine at part load it has to be throttled and thus produces a manifold vacuum the production of which wastes a significant portion of the engine power. This is referred to as "throttling losses". On the other hand, operating an engine on one-half of its cylinders requires less throttling thereby reducing the vacuum produced and, in turn, greatly reducing "throttling losses". Also, during reduced number of cylinders-operation combustion takes place in only the "active" cylinders as a result of which considerably less heat radiating surfaces are dissipating the combustion energy.

PRIOR ART DEVICES

In the past it has been extremely difficult to achieve split engine operation in such a manner as to make the transition between all- and half-cylinders-operation smooth enough to be acceptable to an operator. It has also been difficult in practice to achieve the theoretically expected fuel economy and particularly in view of the now mandated emission control requirements.

In my prior U.S. Pat. No. 2,878,798 entitled "Split Engine" there is shown a mechanism for achieving engine operation utilizing either all or half of the engine cylinders, and in my U.S. Pat. No. 4,080,948 an improved method is described. This invention is a more general solution to the Split Engine than No. 4,080,948 and combines the split engine operation with the catalytic converter and exhaust gas recirculation system used for exhaust emission reduction of CO—$(CH)_n$—NOX (carbon monoxide, hydrocarbon, and nitrogen oxides).

SUMMARY OF INVENTION

It is to be understood that the present invention is applicable to all types of carburetted, fuel injected and the like types of engines so long as there are at least two cylinder combustion chambers. Not only is the invention applicable to a conventional piston engine but it may also be applied to a so-called "rotary" or Wankel type engine utilizing at least two rotors supplied by separate intake manifolds. Thus, the hereinafter use in the specification and claims of words such as "internal combustion engine", "cylinders", "pistons" and the like, is meant to comprehend rotary type engines and their functionally equivalent or related components such as "combustion chambers", "rotors" and the like. Likewise, reference to an "air metering mechanism" shall include carburetors, fuel injection systems or the like wherein the flow of combustion air is throttled or metered by suitable throttle valve means to control engine power output.

In my invention U.S. Pat. No. 4,080,948 I described and claimed that for the smooth transition from all cylinder operation (ACO) to half cylinder operation (HCO) it was necessary to have a common metering air or fuel system for both manifolds, incorporating throttle or throttles. To achieve H.C.O. one intake manifold should first be intercepted from the Meter. Then the same intake manifold opened to atmospheric air. The example of device described in invention U.S. Pat. No. 4,080,948 consisted of a shuttle that performed the two operations in succession.

In the present invention the shuttle function is divided into two valves, one shutting the flow from the meters to the manifold to be inactivated. In series with it a second valve opens said intake manifold either to atmospheric air or to the exhaust manifold. Means shall be described that recirculate the air or exhaust of the inactive cylinder, thus preventing exhaust dilution of active cylinder exhaust and lowering it and catalytic converter temperatures. Also means have been inverted to convey to the active cylinders (A.C.) the exhaust gas recirculation used for the reduction of the nitrogen oxides (NOX) generated by the active cylinders.

The detail of the subject invention will be described with the following drawings.

FIG. 1 is a cross sectional view showing the split engine device positioned between the carburetor and intake manifold.

FIG. 2 is a plain view of split engine control device taken along line AA of FIG. 1.

FIG. 3—3A and FIG. 4 are the exploded views of the open and shut positions of the rotary valve used.

FIG. 3AA is the side view of FIG. 3 and 3A.

FIG. 3E is the enlarged view of the valve activating mechanism.

FIG. 3B is the cross section B—B of FIG. 3E.

FIG. 3C is the cross section of the cable guide.

FIG. 3D is the end view of the cable guide.

FIG. 4 is the valve seat plate.

Figure 5:
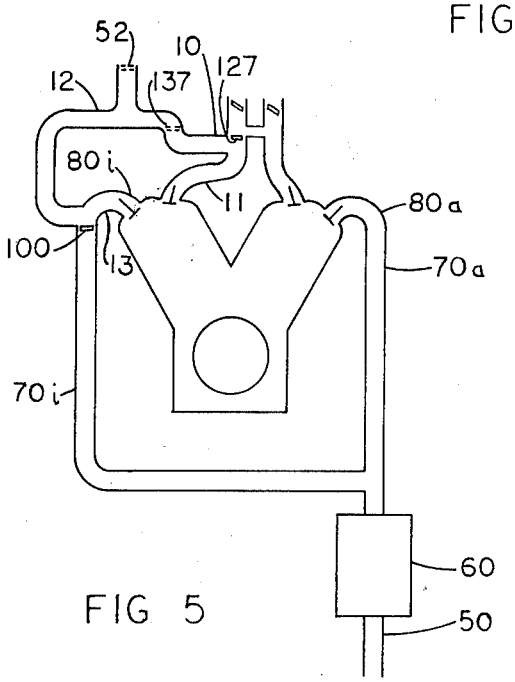
Figure 6:
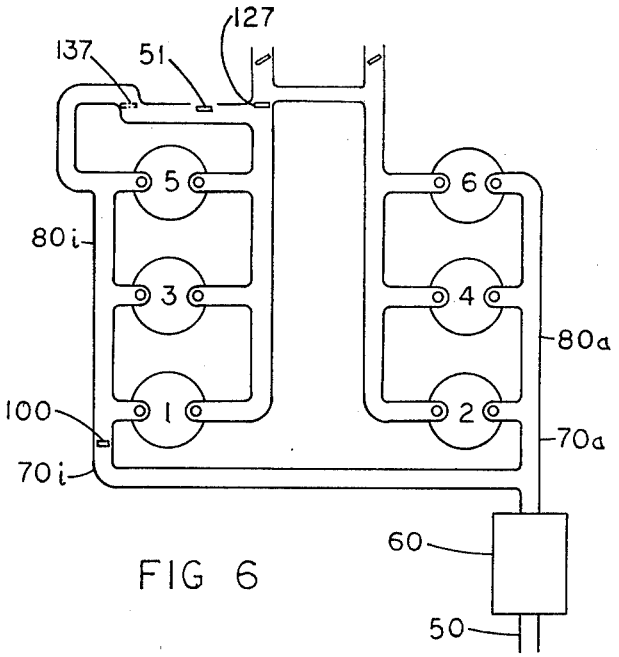

FIGS. 5–6 are respectively skematic cross sectional view and plain view of engine with split engine control with air and exhaust manifold rotary valves.

Figure 7:
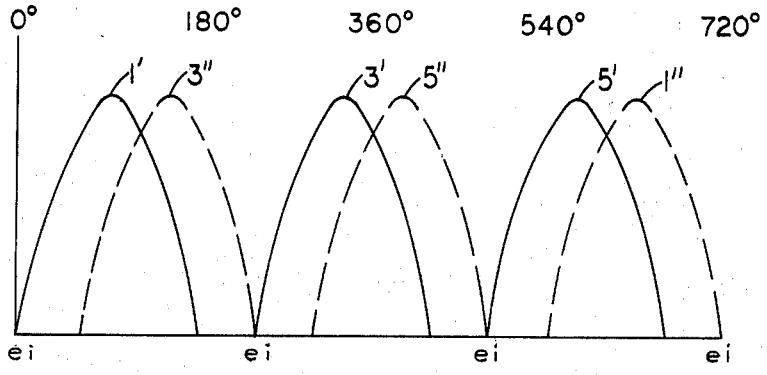
Figure 8:
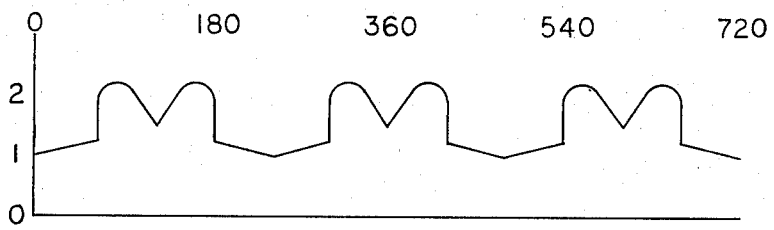
Figure 9:
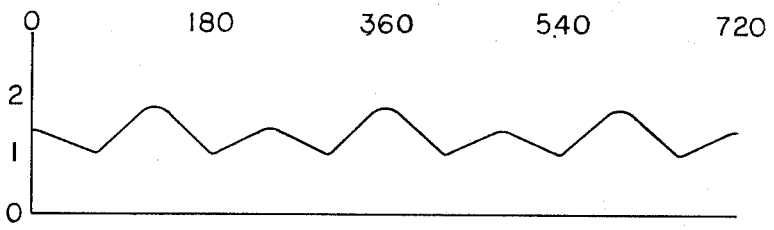

FIGS. 7–8–9 are the diagrams describing the thermodynamic cycles of cylinder and interconnecting system of FIGS. 5 and 6.

Figure 10:
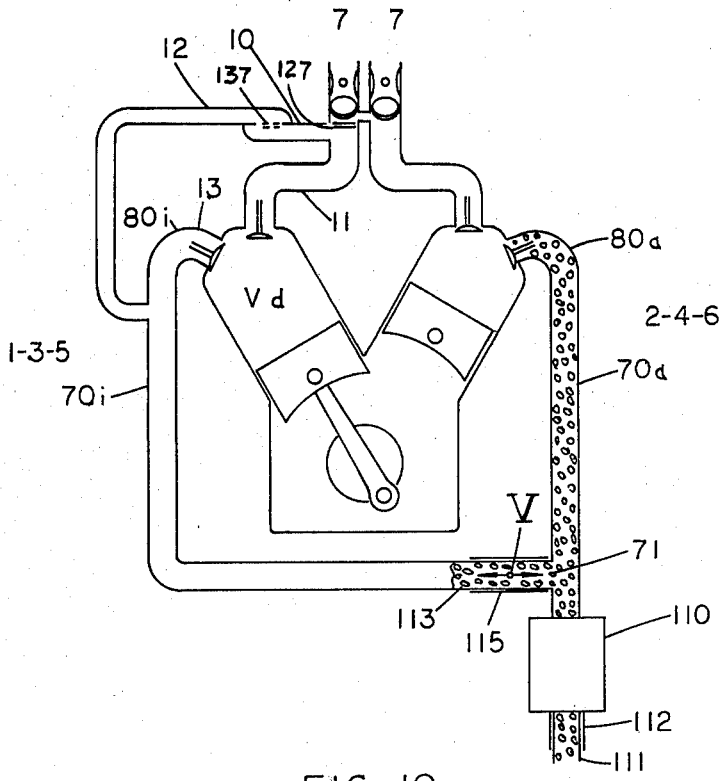
Figure 11:
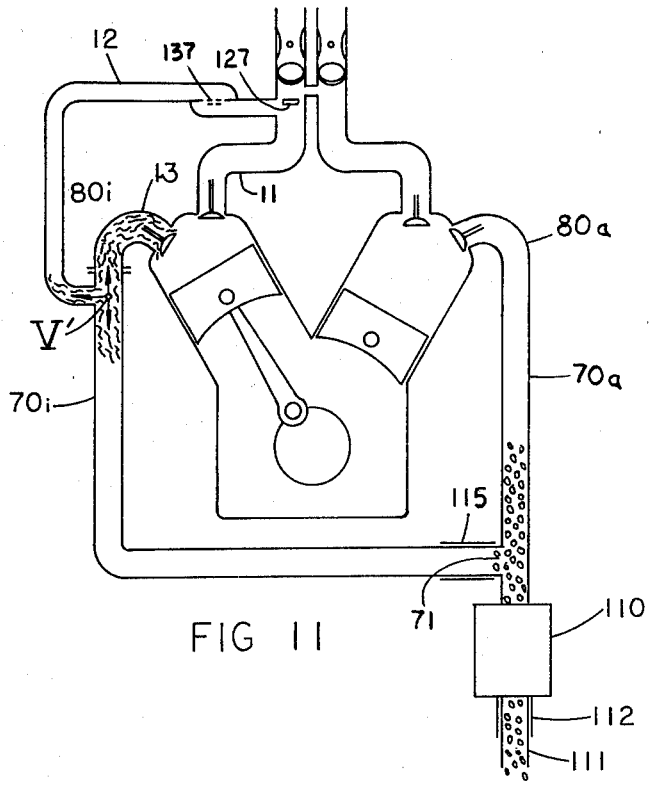

FIGS. 10–11 are the equivalent arrangement of FIGS. 5 and 6 using the engine exhaust system to absorb the intake manifold and exhaust manifold pulsation of the I.C. thus simplifying the system.

Figure 12:
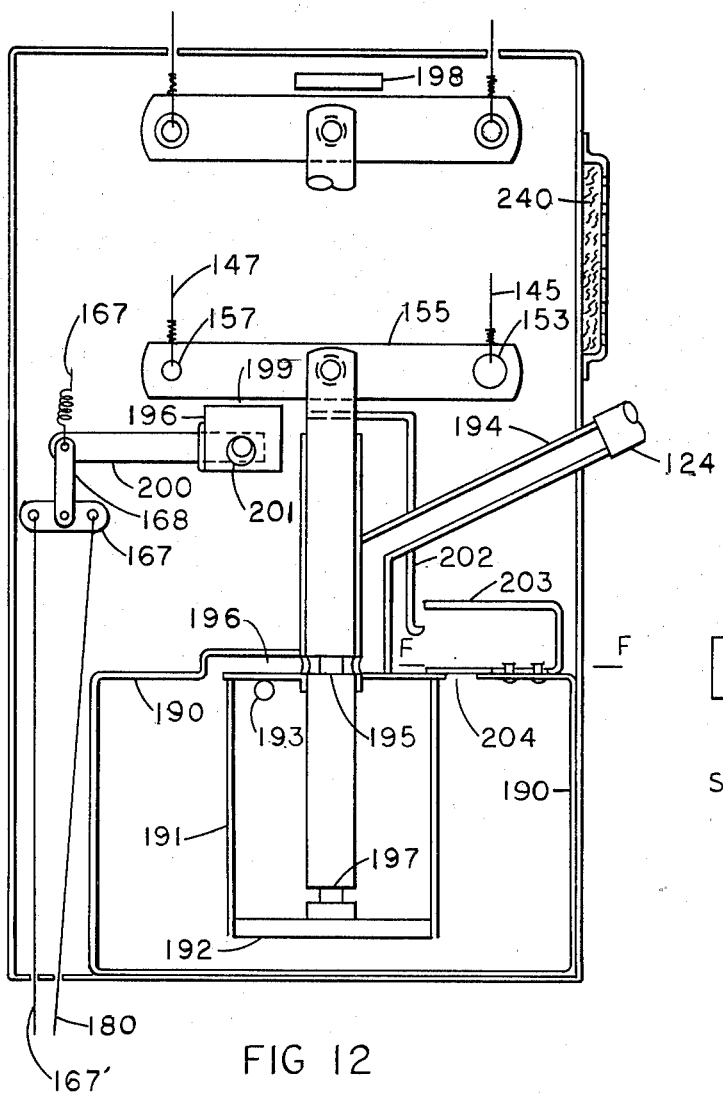

FIG. 12 is the automatic control.

Figure 13A:
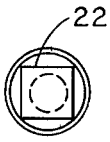
Figure 13:
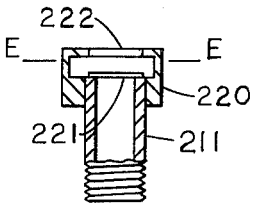

FIGS. 13–13A describe a double check valve to prevent exhaust gas recirculation to I.C. intake manifold.

Figure 14:
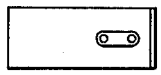

FIG. 14 is the cross section DD of air inlet valve of FIG. 12.

Figure 15A:
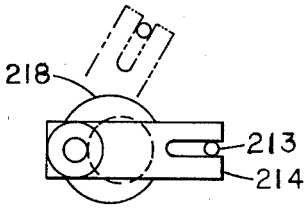
Figure 15:
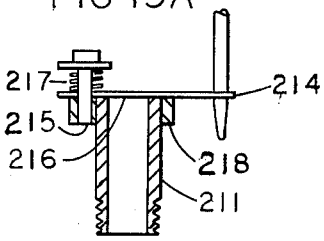

FIGS. 15–15A are the top view and cross sectional view FF of EGR valve for split engine.

In the summary of invention U.S. Pat. No. 4,080,948 a single member called shuttle performed the function of:

a. sensing the manifold vacuum and at pre-selected values b. changing engine operation from all cylinders to part of them by:

deviating the mixture from the inactive cylinders to the active cylinders and simultaneously shutting off the flow to the inactive cylinder manifold then c. opening to atmosphere the inactive cylinders manifold.

In the present invention the inactive cylinders gaseous operating fluid is either:

d. if air is discharged to atmosphere instead to exhaust catalytic cvonverter or e. recirculated if air or exhaust thus facilitating the warm up of the catalytic converter after an engine cold start.

To achieve this result and/ or to use the split engine cycle with 4 barrel carburetors additional valves must be used. Thus an external valve activator is desirable as it will be described later. Furthermore this new invention permits to reduce the space required between the intake manifold and air cleaner, thus permitting its use as a retrofit of existing vehicles where the vertical clearance between air cleaner and hood is critical. Means have been added to lock the device so it operates only some of the engine cylinders until the accelerator pedal is depressed to engine high power, thus achieving greater fuel economy. The manufacturing of the device has been simplified to reduce its weight and cost.

FIG. 1 is a vertical section DD of FIG. 2 of a mixture metering device 114 with throttle or throttles 115-116 mounted on a common shaft 118. A thermal barrier 120 prevents heat from boiling the fuel of metering device 114. Spacer 122 provides a gradual enlargement 119 from throat 117 to valve plate 123 with pierced fenestrations 121 (see also FIG. 4) it has also the large cross passage 124 to handle flow from 117 to 128. Pin 125 is secured to plate 123 by press fit into hole **125*p* and valve 127 can freely rotate around said pin and under plate 123. Thrust bearing 129 supports the downward pressure upon valve 127**.

The upper face 127 of the above valve is flat as is the lower face 131 of plate 123. The clearance between pin 125 and valve hole **125*h*** is large enough so the valve is free to lay flat against the plate when upward pressures are present.

Lower body 132 has a passage 128 feeding the active cylinders (A.C.) connected with branch 130 of engine intake manifold. Said body has a gradual flow section reducer 119' to facilitate flow from fenestrations 121 to manifold branch 133 when the inactive cylinders are operating because valve 127 is open. When valve 127 is closed, as shown in FIGS. 1-2 flow originates from 135 which receives either air and/or recirculating exhaust which shall be called gaseous fluids (GF) and it will be described later.

The G.F. enters fenestrations 137' when valve is open as in FIGS. 1-2-3-4 . Both valves 127 and 137 have a peripheral groove 139, FIG. 3AA-FIG. 3E. Within the groove are two cables or music wires 141-143 for valve 127 and 145-147 for valve 137. The mounting of said cables and the way the valves are rotated shall be described for valve 127 only since 137 operates in the same way.

Cable 141 and 143 are secured to their valve respectively at 141' and 145' FIG. **3*b*, thus they pass along each other at X—. Since the valve operates in the induction system, air leaks from the outside must be minimal. Thus said cables are led outwardly through orifices 141'', 143'', FIGS. 3C-3D within plastic blocks 150. Said blocks have a slot 151 through which the cable or wire is inserted prior to the assembly of the blocks into the body 132. End 141*s* is secured to spring cup 149 which receives the returning force from spring 151**.

The commanding force is applied to cable 143 engaged through spring 173 to pin 153'' of differential lever 155. Similarily cable 147 is engaged through spring 177 to pin 157 at the other end of lever 155. As previously stated, the kinematic operation of valve 137 and its attachment, is similar to 127, but spring 161 is approximately 4 times stronger than spring 151.

At midway of differential lever 155 is pin 163 that in FIG. 2 engages with pull rod 165 manually operable by handle 167.

Stops 169 defines the closed and open positions of valve 127 which is shown closed. Similarly stop 171 defines the open and closed positions of valve 137 shown open. The above valve setting being performed by pulling handle and lever 155 against stops 169' and 171' at which position detent 170 locks 165 in place.

As shown in FIGS. 1 and 2, the device is in the position causing all the metered air or fuel air to go to the cylinders of manifold 130 and air or recirculating self-cooled exhaust to return from 135, valve 137, passage way 132' to manifold 133 and to the inactive cylinders.

To obtain all cylinder operation, handle must be pushed inwards causing the following:

Pin 163 will thus move to 163'',

Lever 155 will swing to 155'' because spring 161 minus rotating friction of valve 137 is stronger than spring 151 minus rotating friction of valve 137. Thus spring 161 acting on cable 145 will rotate valve 137 until its corner 137'' hits stop 171. Said rotation will cause cable 147 to wind into groove of valve periphery.

Thus, the flow of air or recirculating exhaust to manifold 133 is stopped. Spring 151 thru cable 141, valve 127, cable 143 will keep retracting pin 153'' to 153' lever and handle connected to it.

Thus, fenestrations 121 becomes open and the metered air and fuel reach the I.C. and powers them.

The described sequence prevents intercommunication of 135 manifold, 133 and 130, when 135 pressure within it is greater than 130 internal pressure. The above condition would cause engine misfiring if enough dilution of incoming mixture is caused by the air or exhaust from 135.

To restore split engine operation, the driver should pull handle all the way out. Because spring 151 plus friction from rotating valve 137 is approximately less than one-fourth of spring 161 and friction of rotating valve 137, it will let pin 153' and its cable 143, valve 127, be the first to rotate to stop 169 and shut fenestrations 121 and intercept the mixture to the inactive cylinders. The completion of tfhe pull will open the other valve and establish the air flow or recirculating exhaust flow to the I.C.

This manual arrangement permits the continuous operation of the engine in the economy range until the throttle 181 FIGS. 1-1A, is depressed to a preselected value; for example, to 50% opening, when tab 230 engages end 182 of cable 180 secured at the other end to interlock 170, thus releasing the system which through the action of spring 151 and 161, will restore all cylinder operation.

Another way to operate the "split engine" control consists of using the vacuum from interconnecting passage 124 by means of conduit 124', FIG. 1, ending at passage 194, FIG. 12, intercommunicating through groove 195, passage 196 to vacuum reservoir 190 within which a cylinder 191 with piston 192 receives the vacuum action at its lower face, and atmospheric pressure at its upper face because of atmospheric vent 193.

Magnet 196 and vacuum on the piston and friction balance the pull of spring 151–161 until vacuum drops to a predetermined value; for example, 2 in Hg, then the springs restore all cylinder operation as previously described for the manual control. Wire hook 202 by momentarily lifting 203 from opening 204, eliminates the residual vacuum; facilitating the upward piston movement. Thus, groove 197 will line up with passages 194 and 196 to receive next vacuum activation from cross over 124, FIG. 1. The system is held to the A.C.O. by the springs 151 and 161 and magnet 198 until vacuum at engine manifolds is: for example, 12 in. Hg, or more and half cylinder operation is more economical. Then the vacuum on piston 192 will reverse the previous cycle.

As shown in FIG. 12 magnet 196 is spaced with a gap 199 from 155. This gap can be reduced by letting in cable 167' anchored to differential lever 167 with fulcrum 168 so spring 167" rotates lever 200, its eccentric 201 to reduce gap 199. The intensified magnet pull will keep the system at H.C.O. even when vacuum drops to zero; thus, extending the best economy condition to the brief accelerator throttle fluctuation habitual with some drivers.

As in the manual control previously described cable 180 momentarily returns magnet 196 to normal gap at substantial throttle openings.

240 is an air cleaner since valve 204 allows air suction into the device. To preserve normal operation of exhaust gas recirculating systems (E.G.R.) the interconnection 210 of exhaust nozzles 211–212 must be shut off at H.C.O. This can be done by adding to rotary valve 127, pin 213, FIG. 1 and FIG. 15, which engages flat valve 214 pivoted at 215 and held against 218 by spring 217. From nozzle closed as shown in FIGS. 1–15 and its plan view FIG. 15*a*, the rotations that opens valve 127 is communicated by pin 213 to 214, opening nozzle 211.

Another way is to provide nozzle 211 with a double acting disc valve 221 held within 220. During the transient, the very high depression in manifold 133 when 127 is shut and 137 is not opening yet, disc 221 will shut 222. After valve 137 opens, pressure within 133 is greater than at 130 and passage 210, disc valve 221 shuts 211.

It is evident that this device operates only when E.G.R. at 210 stays below atmospheric pressure.

Figure 16:
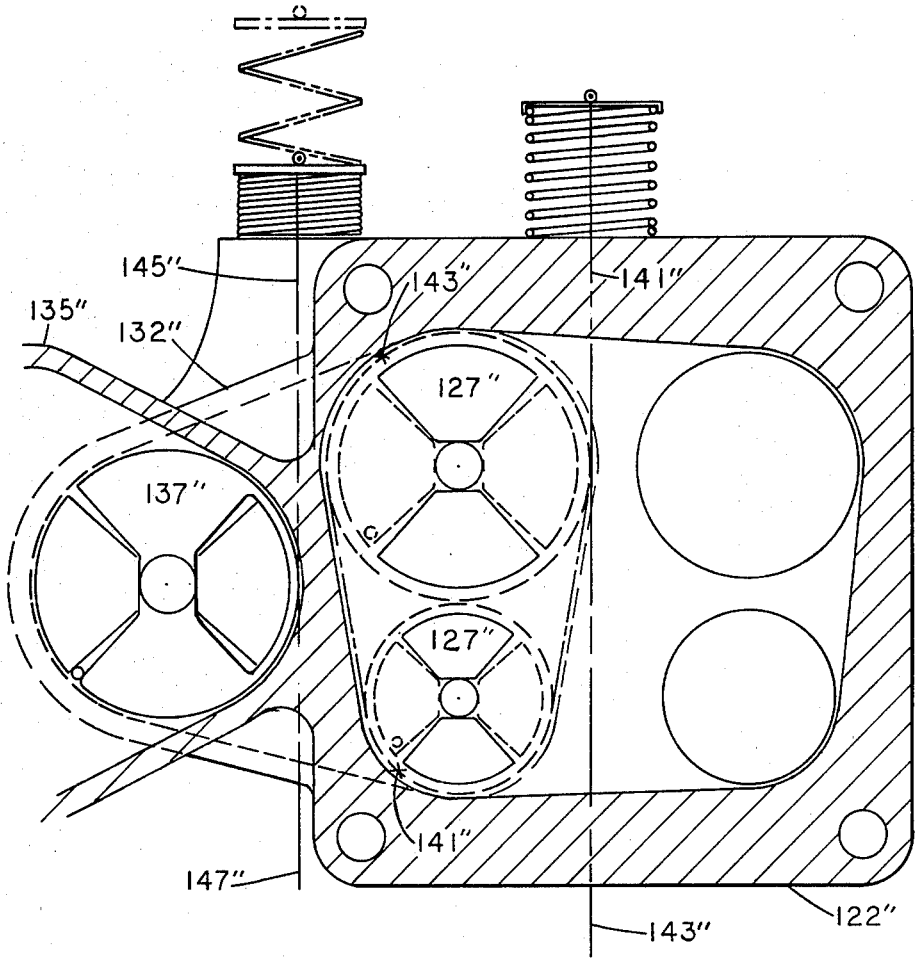

FIG. 16 shows the arrangement for a four barrel carburetor in which each intake manifold of the engine is fed by a larger barrel and a small barrel; the latter supplies fuel at idle and low power; the large barrel comes in at higher power.

Thus to inactivate the cylinders of one manifold, it requires two synchronized valves, both indicated by 127" and functioning exactly as the previously described valve 127 of FIGS. 1–2. Both valves are secured to a common cable at 143" and 141" respectively functioning as 141–143.

The identical functioning of this system for the four barrel carburetor to the one previously described for the two barrel, does not require a duplicate description. To readily recognize the equivalent components, the double comma has been used in FIG. 16 for the identification numbers of FIGS. 1 and 2.

Reduction of emission of CO, (CH)n, NOX is often achieved by catalytic converters whose effectiveness requires fairly high exhaust temperatures. This invention includes means to prevent the dilution of the exhaust from the A.C. with the air or exhaust from the I.C.

One obvious way is to return the air from the I.C. to the air inlet of the I.C. FIG. 5 refers to power plant with any of the split engine controls previously described.

The exhaust manifold 80*i* for the I.C. must be independent from the exhaust manifold of A.C. 80*a*. Exhaust manifold 80*i* has an intercepting valve 100 closing after valve 127 is closed. Valve 100 is between exhaust manifold 80*i* and exhaust pipe 70*i*. Valve 137 is opening or opened simultaneously to the closing of valve 100. Also air inlet 52 should open at the same time. Thus the various gases of this closed system of I.C. and their manifolds would mix together and recirculate. If exhaust intercepting valve 100 is closed after valve 127 and the opening of valve 137 and no communication with outside air is established, the pressure within the recirculating system and the gases in it would be momentarily that of the exhaust at the shut off of valve 100 followed by a decrease due to exhaust cooling.

To illustrate the operation of this system, the 6 cylinder V-6 engine will be illustrated as an example. The commonly used firing order of the V-6 is: 1–6–5–4–3–2. FIG. 6 shows the schematic arrangement of the V-6 engine whose cylinder numbers indicate the operation of the previously mentioned firing order.

It is evident that exhaust manifold 80*i* accept only I.C. and exhaust manifold 80*a* accept only A.C.

FIG. 7 is a diagram whose abscissa represents crankshaft angle and ordinates the piston displaced volume of the I.C. of a V-*6* cylinder engine. One cylinder displacement being one.

Curves 1'–3'–5' represent suctions,

Curves 1"–3"–5" represent exhausts. The overlap of suction 1' and exhaust 3" shows that only 50% of direct recirculation between cylinders takes place. The remaining exhaust from 3" will be compressed in the volume enclosed by the system 10–11–12–80*a*–13. These passages plus the cylinders with intake or exhaust valve open shall be called "the system".

At FIG. 8 we assume the same abscissa as FIG. 7. The ordinate are system volume in which 10–11–12–8-0*i*–13 is assumed equal to the displacement of one cylinder. It follows: ei is the end of 1" exhaust and the beginning of its intake stroke 1' and the volume of this system is one.

Sixty crankshaft degrees later, the intake piston swept volume being 0.25, the system volume will be 1.25. The next cylinder exhaust opens to the system, thus the volume will read 2.25 @ 120°, the volume is 1.5, etc.

FIG. 9 has the same abscissa as FIGS. 7–8. The ordinate shows the approximate absolute pressure within 11–12–13–80*i* assuming the lowest pressure as unity. It is evident that if the lowest pressure is an atmosphere, then the end of the exhaust stroke and the beginning of the intake stroke by the same cylinder is equal to one atmosphere.

To produce the best oil consumption, it is desirable the pressure within the I.C. be above atmosphere, thus an inlet check valve 51, FIG. 6, allowing air into 11–1-2–13–80*i* would be necessary or a valve 52 opening to atmosphere should be used. The check valve produces the higher thermodynamic efficiency.

FIG. 10 shows a simplified recirculating cycle in which check valve 5 or atmospheric valve 52 and exhaust valve 100 are not required. Again cylinders 1–3–5 are inactivated by closing valve 127 and opening valve 137, FIGS. 10–11. Thus the pressure within **10–11–1–2–13–80*i*–70*i* will approximate the exhaust pressure generated by the A.C. at 80*a*–70*a*- and T connection 71**.

At low speed the flow can be described as follows:

When any of the cylinders 1–3–5, for example cylinder 1 start suction it will: FIG. 7 first 60° draw from **11–12–13–80*i*–70*i* and thru elbow 71 approximately 43% of cylinder displacement by causing exhaust from 70*a* to flow a volume V approximately equivalent to the one aspirated by cylinder 1**.

Then cylinder 3 will exhaust in the I.C. manifold and supply approximately 50% of the requirement for cylinder 1, the remaining 7% being provided by V augmenting to the same extent.

Since cylinder 3 will complete its exhaust stroke and deliver the remaining 50% indicated by V', FIG. 11 to the system, V will be returned to **70*a***.

This reversal of pulsations at the intercommunication of the I.C. and A.C. exhaust systems can be propagated to the catalytic converter, thus increasing its efficiency by prolonging some of the exhaust residence in it.

Except for the first 720° of crankshaft rotation after valve 132 opens, no further hot exhaust will enter the I.C. Thus, no further heat input to them. Thus, the reduction of engine cooling requirements at idle and off idle are still achieved.

This reduction of cooling requirements is important to prevent boiling of the cooling systems on air conditioned cars with condenser ahead of radiator and also to reduce cooling fan size and their power consumption.

It is advisable to make exhaust manifold **80*i* with low heat capacity. Exhaust pipe 70*a* and connector 12, passage 10, should be well cooled and capable to rapidly lowering the temperature of the live exhaust trapped within 70*i* and 80*i* at the beginning of the I.C. cycle. Portion 111 and 113 where exhaust pulsates back and forth may be insulated by sleeves 112–115**.

If an interconnection 40 of the active and inactive cylinders through the intake manifold hot spot is used, FIG. 1 then a thermostatic valve 51 closed after engine warm up by thermostat 52 or closed at H.C.O. by the split engine control would improve the engine cooling and the thermodynamic efficiency of the split engine at H.C.O.

Other modifications and variations may be made within the intended scope of the invention as set forth in the hereinafter appended claims.

That is claimed is:

1. A charge forming system for an internal combustion engine of the type comprising a first and second exhaust passage for alternating cylinders of the engine firing order, the dual exhaust being connected to common catalitic converters, an intake manifold having first passage means communicating with first half of the engine combustion chambers exhausting into the first exhaust passage and second passage means communicating with the second half of the engine combustion chambers exhausting into the second exhaust manifold, an air metering mechanism having third passage means adapted to supply metered air to said first and second intake manifold, passage means, and throttle valve means, said third passage means for controlling the flow of metered air through said air metering mechanism passage means; and a control device for interrupting the flow of metered air from the third passage means to said first intake manifold passage means whereby engine output power is generated only by those engine combustion chambers supplied by said second intake manifold passage means; the improvement comprising the control device having:

A. First valve means disposed intermediate said first intake manifold passage means and said third passage means, said first valve means including a first position allowing open communication between said first intake passage means and said third passage means, and a second position blocking flow between said first intake passage means and said third passage means, and a second valve means closed at a first position and opened after the second position of the first valve means to communicate with one end of a chamber whose outlet passage is between the first exhaust passage of the inactive cylinders and the second exhaust passage of the active cylinders, B. Means for moving and maintaining said first means in the first position of all engine cylinders operative and alternatively movable to maintain (above) said first valve means in the position permitting only partial engine operation during which the gasses of the chamber between the second valve means and the exhaust system are recirculated within the first half of the, inactive engine substantially excluding the live exhaust of the active second half of the engine.

2. Same as 1 and a means to inhibit the holder of valve means at second position by driver's control when throttle is opened past one fourth of its full angular travel.

3. Same as 1 and the communication chamber between valve means two and the first exhaust passage of the inactive cylinders outlet means said chamber to have a volume equal or greater than the maximum instantaneously difference between inlet and exhaust piston displacement of the first half of the engine inactivated.

4. Same as 3 with the communication chamber outlet joined upstream of the catalitic convertor and downstream of the active cylinder exhaust system.

5. Same as 4 and a means on an engine whose exhaust systems consist of first exhaust passage receiving exhaust from the active cylinders and a second exhaust passage receiving the exhaust from the inactive cylinders recirculation, and causing reversing pulsations of the gaseous medium to take place within them.

6. A charge forming system for an internal combustion engine comprising first and second exhaust passages and intake manifolds for alternating cylinders of the engine firing order, the dual exhaust being connected to common catalitic converters, an intake manifold having first passage means communicating with first half of the engine combustion chambers and second passage means communicating with the second half of the engine combustion chambers; an air metering mechanism having third passage means adapted to supply metered air to said first and second intake manifold passage means, and throttle valve means upstream said third passage means for controlling the flow of metered air through said air metering mechanism passage means; and a control device for interrupting the flow of metered air from the third passage means to said first intake manifold passage means whereby engine output power is generated only by those engine combustion chmbers supplied by said second intake manifold passage means; the improvement comprising the control device having:

A. First valve means disposed intermediate said first intake manifold passage means and said third passage means, said first valve means including a first position allowing open communication between said first intake passage means and said third passage means, and a second position blocking flow between said first intake passage means and said third passage means, and a second valve means closed at first position and opened after the second position of the first valve means, to communicate with engine first exhaust passage of the inactive cylinders whose outlet is provided with a third valve which is closed when first half of engine is inactivated.

7. Same as 6 with a check valve between atmosphere and first intake manifold.

* * * * *